US012564778B2

(12) United States Patent
Maslin

(10) Patent No.: US 12,564,778 B2
(45) Date of Patent: Mar. 3, 2026

(54) PORTABLE, FOLDABLE LINE DEMARCATION SYSTEM

(71) Applicant: Lawrence Alan Maslin, Parker, CO (US)

(72) Inventor: Lawrence Alan Maslin, Parker, CO (US)

( * ) Notice: Subject to any disclaimer, the term of this patent is extended or adjusted under 35 U.S.C. 154(b) by 0 days.

(21) Appl. No.: 18/439,734

(22) Filed: Feb. 12, 2024

(65) Prior Publication Data

US 2025/0256196 A1 Aug. 14, 2025

Related U.S. Application Data

(60) Provisional application No. 63/446,318, filed on Feb. 16, 2023.

(51) Int. Cl.
*A63C 19/06* (2006.01)

(52) U.S. Cl.
CPC ..... *A63C 19/065* (2013.01); *A63C 2019/067* (2013.01)

(58) Field of Classification Search
CPC ..... A63C 19/065; A63C 2019/067
See application file for complete search history.

(56) References Cited

U.S. PATENT DOCUMENTS

2019/0321713 A1* 10/2019 Hackenberger ..... A63B 63/08
2024/0374985 A1* 11/2024 Di Laura ..... A63C 19/08

* cited by examiner

*Primary Examiner* — Vishal I Patel
(74) *Attorney, Agent, or Firm* — Robert Brownstein

(57) ABSTRACT

The invention is a portable, foldable line demarcation system comprising line demarcation slats comprised of slat segments, hinging fixtures, and inter-slat attachment fixtures. The line demarcation slats are deployed such that they form side lines, back lines and interior lines compliant with sports authority play-area standards or rectangular-area standards describing allocated areas of use.

7 Claims, 7 Drawing Sheets

301

301

PORTABLE, FOLDABLE LINE DEMARCATION SYSTEM

This application claims the benefit of provisional application, 63/446,318, having filing date of Feb. 16, 2023.

TECHNICAL FIELD

The invention is a portable, foldable system of line demarcation structures for marking lines based on sports standards for courts of play and for allocated rectangular areas.

BACKGROUND OF INVENTION

Sports authorities adopt standards for rules of play and for areas of play. For example, a gymnasium may have lines marked on its floor that comply with standards established for volleyball, basketball, indoor tennis and so on. Trade shows held in convention centers may have booth areas allotted with specific areal dimensions. Here, too, there may be lines marked on the floor that correspond to allocated spaces.

In most cases, the lines marking sports standard play areas are essentially permanently marked using such means as paint or a material meant to adhere, permanently, to a floor surface.

More and more, play areas are set up, on the fly, and then removed after use for such sports as volleyball and pickleball. Similarly, convention centers will host trade shows having space allocations that may differ significantly. In such cases, permanently marked lines would be disadvantageous.

Temporary setups, using thin, colored, vinyl tape are, at best, makeshift solutions where during play they can be torn, or displaced, even windblown.

On the other hand, a more permanent solution, such as paint or adhesive-backed strips may not be allowed, or provide only a single-use solution.

BRIEF DESCRIPTION OF INVENTION

The invention herein described and claimed is a portable, foldable line demarcation system that provides the robustness of a permanently lined space with the portability and multi-use capability of a more temporary solution.

Lines are marked by laying down demarcation line slats which are comprised of segment slats, joined by slat-segment hinging-joint fixtures, to create side lines, back lines and interior lines based on sports authority play area standards or allocated space dimensions.

The ends of side line demarcation line slats are joined to ends of back lines using inter-slat attachment fixtures. The ends of interior lines will attach to side-line demarcation slats, or back-line demarcation slats at points along their lengths determined by play-area standards or allocated space dimensions using inter-slat attachment fixtures.

When deployed, the portable, foldable line demarcation system is a full-sized, rectangular area compliant with sports play-area standards or allocated space dimensions that includes interior lines, side lines and back lines. But, when removed and stored, the slat-segment hinging-joint fixtures are operative to enable the side-line slats, interior-line slats and back-line slats to be zig-zag folded (also known as "accordion folded") such that the folded side-line, interior-line and back-line slats converge to form a cuboid that can be easily stored or transported.

DETAILED DESCRIPTION OF INVENTION

Figure 1:
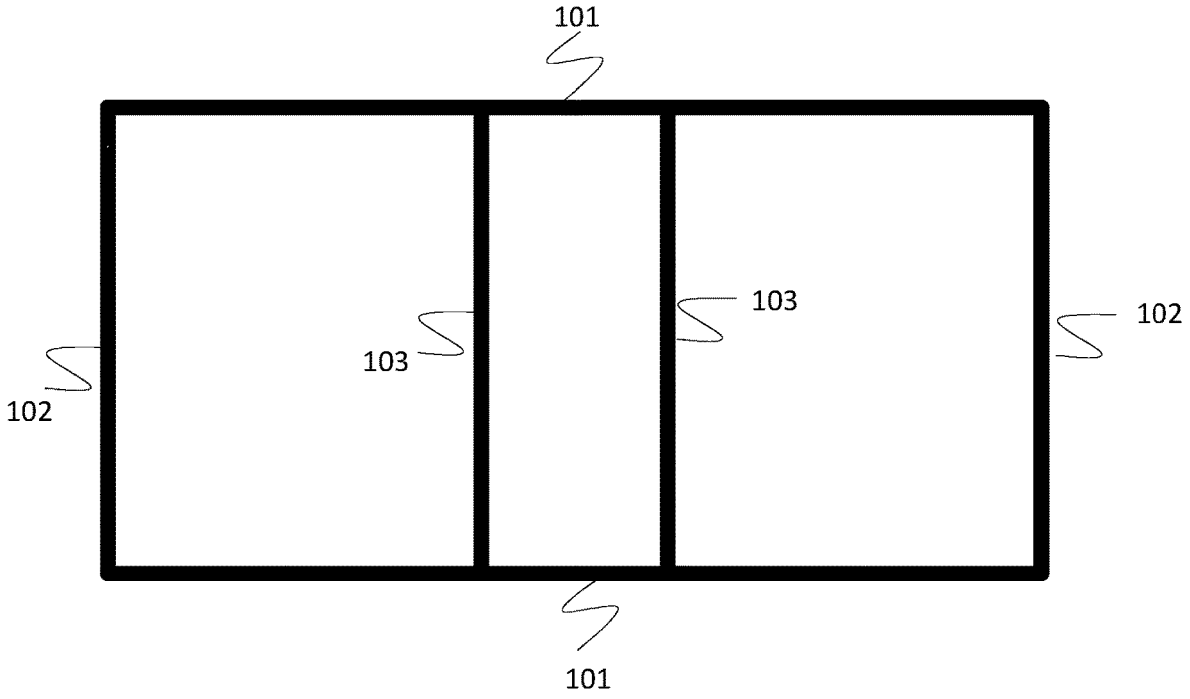
FIG. 1 shows a play-area layout consistent with a volleyball court.

Where a gymnasium is dedicated to a specific sport or sports, permanent line demarcations are typically deployed using such means as paint or materials that adhere permanently to floor surfaces. This is often the case with other surfaces such as outdoor tennis courts, playgrounds, parking lots, and surface streets.

Where an area is open to a variety of sports, each having different dimensions and possibly interior-line requirements, permanent demarcation is not a solution for line demarcation.

Portable solutions using light-weight court-line tape, perhaps held in place by distributed weights or adhesives is, often, a makeshift solution, at best, that may be torn, displaced, or windblown, creating distractions and play-rule discrepancies. Light precipitation and moisture often causes adhesives to fail. When removed, the court-line tape usually is discarded, making it a single-use solution.

A portable, multi-use line demarcation system, with the robustness of a permanent solution plus the portability and utility of a temporary solution. Ideally, when deployed, it would have the positional integrity of a painted line or permanently adhered line material. When it is ready to be redeployed, it would be easily removed and folded for storage or transportability.

The portable, foldable line demarcation system comprises low-profile slates having equal-dimension top and bottom faces and thickness in a range of 1 to 13 mm. With that thickness, when deployed, the low-profile slats are stiff enough to resist horizontal skewing whereas being thin enough to be only slightly higher than the floor surface and in compliance with the International Residential Code's (IRC) maximum height of a threshold in an accessible route.

The same type of slats is used for side lines, back lines and interior lines. Widths would be the same for all, and lengths would be determined by sports authority standards for play-area demarcation (e.g. line length and width for side, back and interior lines).

The slats are comprised of slat segments joined by slat-segment-hinging-joint fixtures. These joint fixtures are operative such that the leaf on each side may open to a fully horizontal orientation, wherein their angular displacement is 180 degrees and the leaves are coplanar; and may rotate in only one direction until angular displacement is essentially 0 degrees and the leaves are parallel.

A rectangular play area is implemented by fully unfolding the side-line slats, back-line slat and interior-line slats, then arranging them such that slide-line slats and back-line slat can be attached at their respective corners using inter-slat-attachment fixtures. Once the outer rectangular areas are thus formed, the interior lines can be attached at predefined attachment points on the side lines and/or back lines. The inter-slat-attachment fixtures are operative to support firm attachments wherein once attached, the slats are fixed in position and resistant to any rotational displacement.

When the portable, foldable line demarcation system is to be removed and redeployed, the side-line slats and connected interior-line slats may be zig-zag folded by essentially using the hinging structures to zig-zag fold them such that the back-line and any parallel interior line are collapsed toward one another. Afterward, the back-line slats and any parallel slats are likewise zig-zag folded and collapsed toward one another. With all the slats thus zig-zag folded and collapsed to a common point, the entire portable, foldable line demarcation system is converged into a cuboid structure that can be easily transported or stored.

The following section, in view of the figures, is intended to make the description more clear. In FIG. 1, the lines (101) are termed "side lines." The lines 102 are termed "back lines." And, the lines 103 are termed "interior lines." Note that in this play area, the back lines and interior lines are mutually parallel while perpendicular to the side lines.

Figure 2:
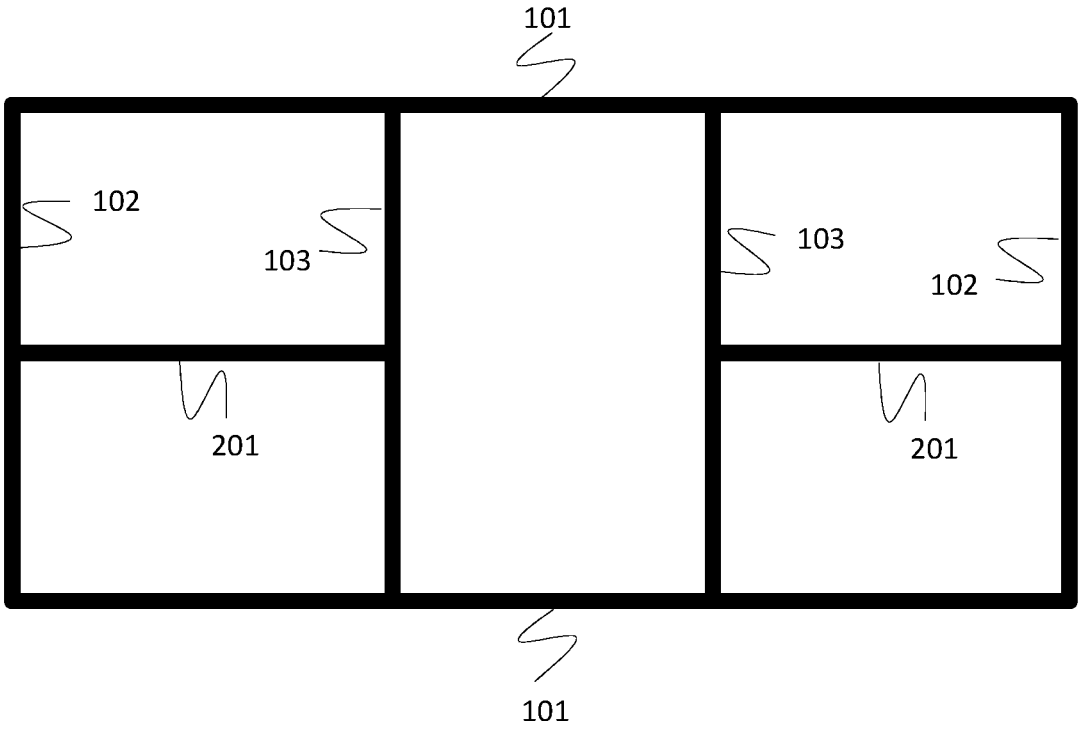
FIG. 2 shows a play-area layout consistent with a pickleball court.

In FIG. 2, representative of a pickleball play area, side lines (101), back lines (102), and interior lines (103) are similarly positioned and oriented. There is an additional interior line (201) which, unlike interior line 103 is oriented parallel to the side lines and perpendicular to the back line and the other interior line. This line 201 denotes a service demarcation as in tennis and in pickleball.

Figure 3:
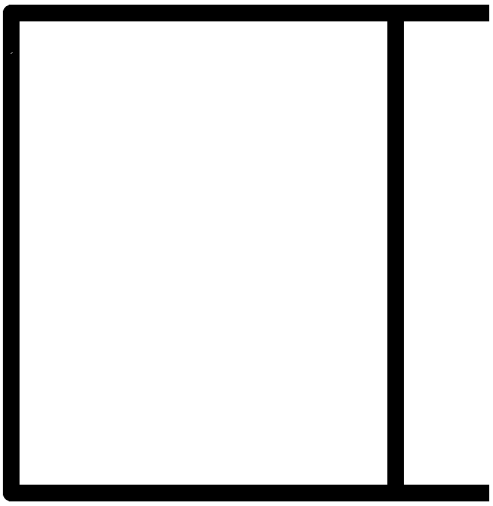
FIG. 3 shows the layout of FIG. 1 divided into two, symmetrical, halves.
Figure 3:
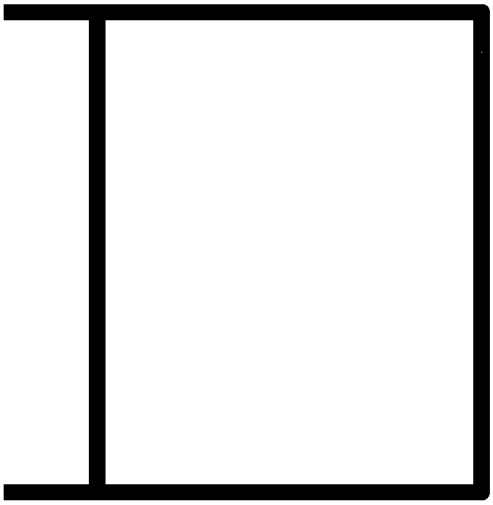

For purposes of implementing the portable, foldable line demarcation system, FIG. 3 shows how the play area of FIG. 1 is divided into two, identical halves (301).

Figure 4:
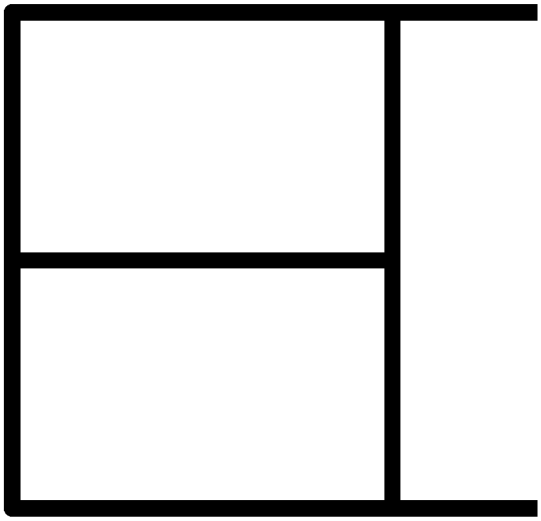
FIG. 4 shows the play-area of FIG. 2 divided into two, symmetrical halves.
Figure 4:
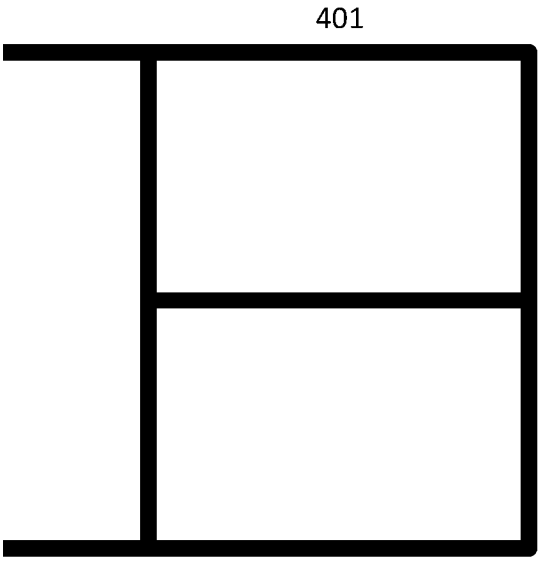
Figure 5:
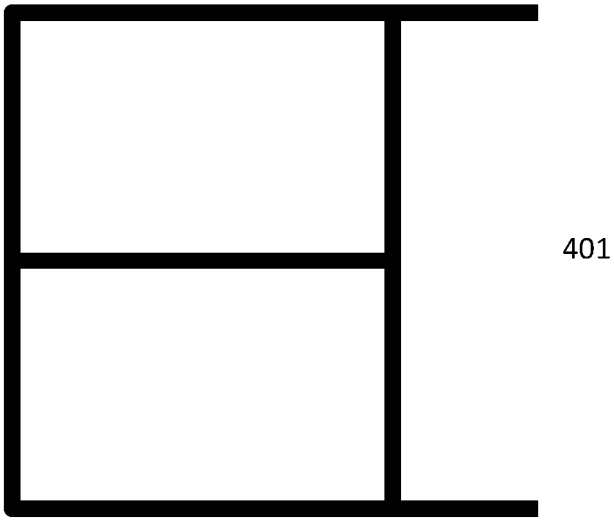
FIG. 5 shows one half of the play-area of FIG. 2 implemented with a set of side-line, back-line, and interior-line slats attached using inter-slate attachment fixtures.
Figure 5:
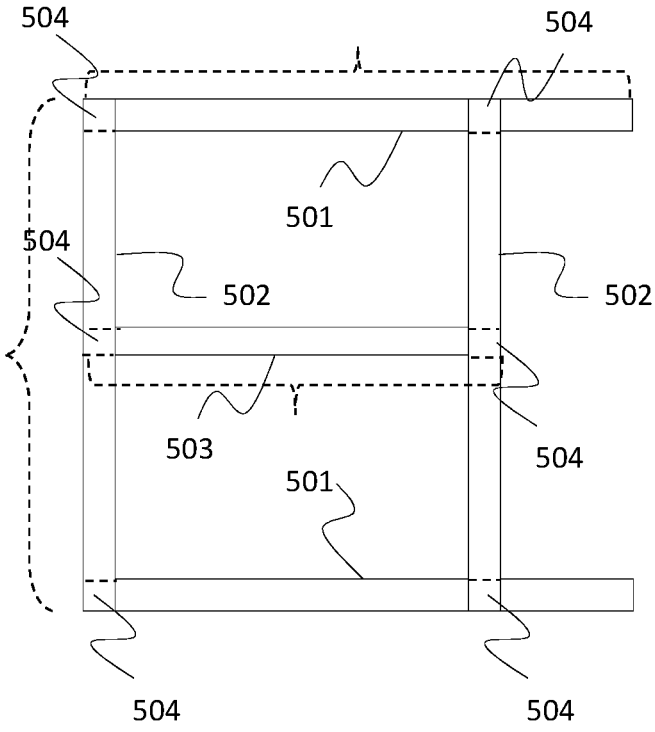

Similarly, in FIG. 4, the play area of FIG. 2 is divided into two equal halves (401).

In this embodiment of the invention, the full play-area solution comprises two half-court implementations.

Using FIGS. 2 and 4, as examples, each court half (401) is implemented with slats as shown. The slats for the side lines are 501. Those for the back-line and its parallel interior line are 502. And that for the second interior line, which is perpendicular to the back line, is 503. Inter-slat-attachment figures are shown as 504.

Figure 6:
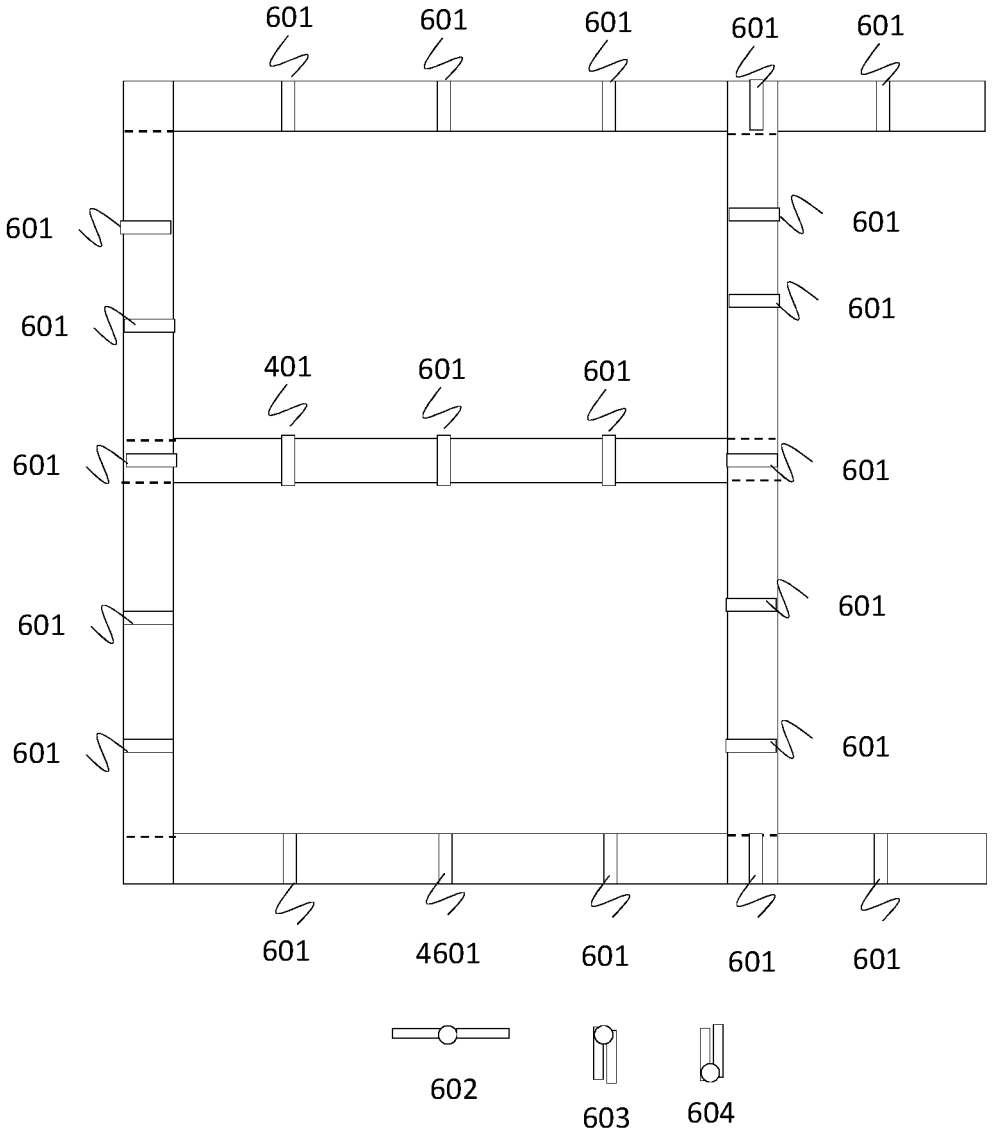
FIG. 6 illustrates how the slat implementation of FIG. 5 comprises slat segments and slat-segment joint-hinging fixtures.

FIG. 6 provides an exemplary view of the court half, 401, showing the slat segments for all the lines and the slat-segment-hinging-joint fixtures (601) that joins the slat segments to form the side lines, back line and interior lines. FIGS. 602, 603 and 604 are side views of a slat-segment-hinging fixture. In 602, the leaves are coplanar representing their orientation when slats are deployed on the floor. In 603 and 604, adjacent slat segment are folded in one direction or the other so as to create the zig-zag folding of the slats.

Figure 7:
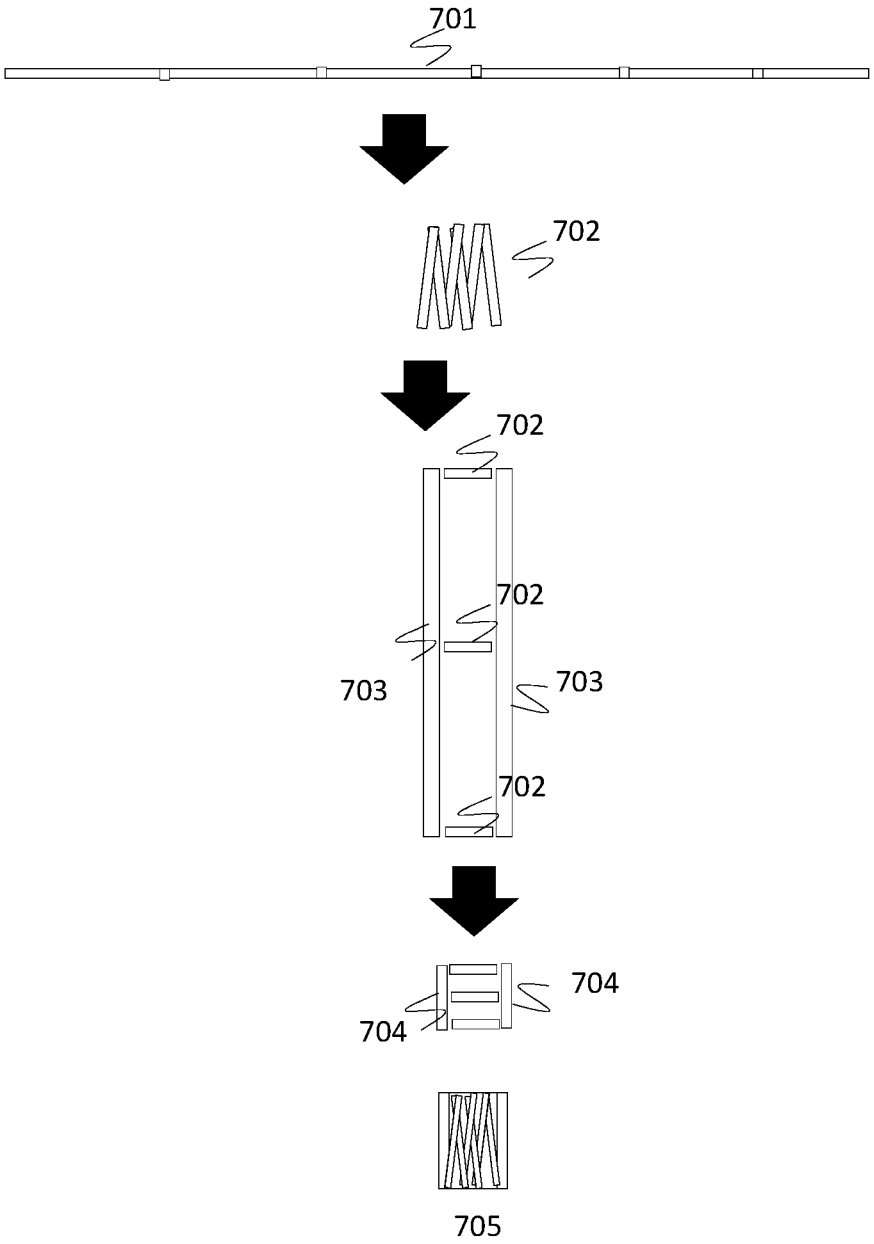
FIG. 7 illustrates how a side-line slat, or back-line slat, or interior-line slat is zig-zag folded, first in one direction, then in the right-angle direction so as to converge and produce a cuboid aggregation.

FIG. 7 shows one side-line slat fully extended (701), the zig-zag folded (703), such that the side line slats are convergent toward one another. Then, the back line and parallel interior line (703) are zig-zag folded (704). Now the slats, all zig-zag folded converge to form a cuboid (705).

The cuboid makes for easy storage and transport of the portable, foldable line demarcation system. When transported to a new location, the cuboid is then extended in one direction until fully extended in that direction; then extended in a transverse direction until fully extended. At that point, all slat lines have been deployed and the play area is fully lined out.

An alternative to collapsing into a cuboid structure, where a cuboid structure is not the best solution, would be removing inter-slat-attachment fixtures, then folding the various demarcation line slats into separate folded entities.

It should be noted that the description and figures are exemplary and should not be read as limiting the patent scope to those specifics.

The slat segments may be comprised of vinyl, epoxy, composite materials, metals or any material creating durable, flex-resistant slats within the range of thickness. Both surfaces of slat segments have non-slip surface characteristics.

What is claimed is:

1. A portable, folding system for laying out demarcation lines comprising a plurality of demarcation line slats;

the demarcation line slats have dimensions compliant with sports-authority standards and rectangular-space allocations;

the demarcation line slats comprise:

slat segments;

slat-segment hinge-joint fixtures;

inter-slat-segment-attachment fixtures;

the demarcation line slats are operative to fold at each slat-segment-hinge joint so as to enable compact storage and handling; and the slat segments enable adjusting overall slat length by choosing an appropriate number of slat segments to join together.

2. The portable, folding system for laying out demarcation lines as in claim 1 wherein:

the slat segments are all low-profile structures.

3. The portable, folding system for laying out demarcation lines as in claim 1 wherein:

the slat-segment hinge-joint fixtures are operative to allow rotation from a horizontal orientation to create a zig-zag folded compact structure of the slat segments.

4. The portable, folding system for laying out demarcation lines as in claim 1 wherein:

the inter-slat-segment-attachment fixtures are operative to establish a firm, in-flexible, non-rotatable attachment.

5. The portable, folding system for laying out demarcation lines as in claim 1 wherein:

both surfaces of the slat segments comprise non-slip surface characteristics.

6. The portable, folding system for laying out demarcation lines as in claim 1 wherein:

each surface of the slat segments may have the same or different color as one another.

7. The portable, folding system for laying out demarcation lines as in claim 1 wherein the slat segments' thickness ranges from 1 to 13 mm.

* * * * *